US005395053A

United States Patent [19]

Frech

[11] Patent Number: 5,395,053

[45] Date of Patent: Mar. 7, 1995

[54] ROTOR NOZZLE FOR A HIGH-PRESSURE CLEANING DEVICE

[75] Inventor: Klaus Frech, Korb, Germany

[73] Assignee: Alfred Karcher GmbH & Co., Winnenden, Germany

[21] Appl. No.: 196,102

[22] Filed: Feb. 18, 1994

[30] Foreign Application Priority Data

Aug. 31, 1991 [DE] Germany ..... 4129026

[51] Int. Cl.[6] ..... B05B 3/04

[52] U.S. Cl. ..... 239/227; 239/237; 239/263; 239/381

[58] Field of Search ..... 239/227, 237, 240, 251, 239/252, 263, 380, 381, 383

[56] References Cited

U.S. PATENT DOCUMENTS

| | | | |
|---|---|---|---|
| 4,073,438 | 2/1978 | Meyer | 239/227 |
| 4,708,290 | 11/1987 | Osmond | 239/227 |
| 4,747,544 | 5/1988 | Kränzle | 239/252 X |
| 4,802,628 | 2/1989 | Dautel et al. | 239/227 |
| 4,951,877 | 8/1990 | Arsi . | |
| 4,989,786 | 2/1991 | Kranzle et al. . | |
| 5,217,166 | 6/1993 | Schulze et al. | 239/227 |
| 5,236,126 | 8/1993 | Sawade et al. | 239/252 |
| 5,328,097 | 7/1994 | Wesch et al. | 239/252 X |

FOREIGN PATENT DOCUMENTS

| | | | |
|---|---|---|---|
| 216034 | 4/1987 | European Pat. Off. . | |
| 252261 | 1/1988 | European Pat. Off. . | |
| 3925284 | 2/1991 | Germany | 239/252 |
| 4013446 | 5/1991 | Germany . | |

*Primary Examiner*—William Grant
*Attorney, Agent, or Firm*—Barry R. Lipsitz

[57] ABSTRACT

In order to limit the rotational frequency of the nozzle body in the housing in a rotor nozzle for a high-pressure cleaning device with a housing provided in a front wall with a pan-shaped bearing for the front, spherical end of a nozzle body having a through-bore, with an insert for a liquid opening tangentially into the housing, the liquid in the housing being caused to rotate thereby about the longitudinal axis of the housing, so that the nozzle body rotates together with the rotating liquid and thereby abuts with a contact surface at its periphery on the inside wall of the housing, whereby the longitudinal axis of the nozzle body is inclined in relation to the longitudinal axis of the housing, it is suggested that a braking member is mounted in the nozzle body at its back end facing away from the front, spherical end for displacement in longitudinal direction of the nozzle body and that a contact surface is arranged adjacent to the back end of the nozzle body at the end face in the housing, the braking member mounted in the nozzle body protruding beyond the end of the nozzle body to abut on this contact surface as soon as the nozzle body rotates in the housing.

22 Claims, 1 Drawing Sheet

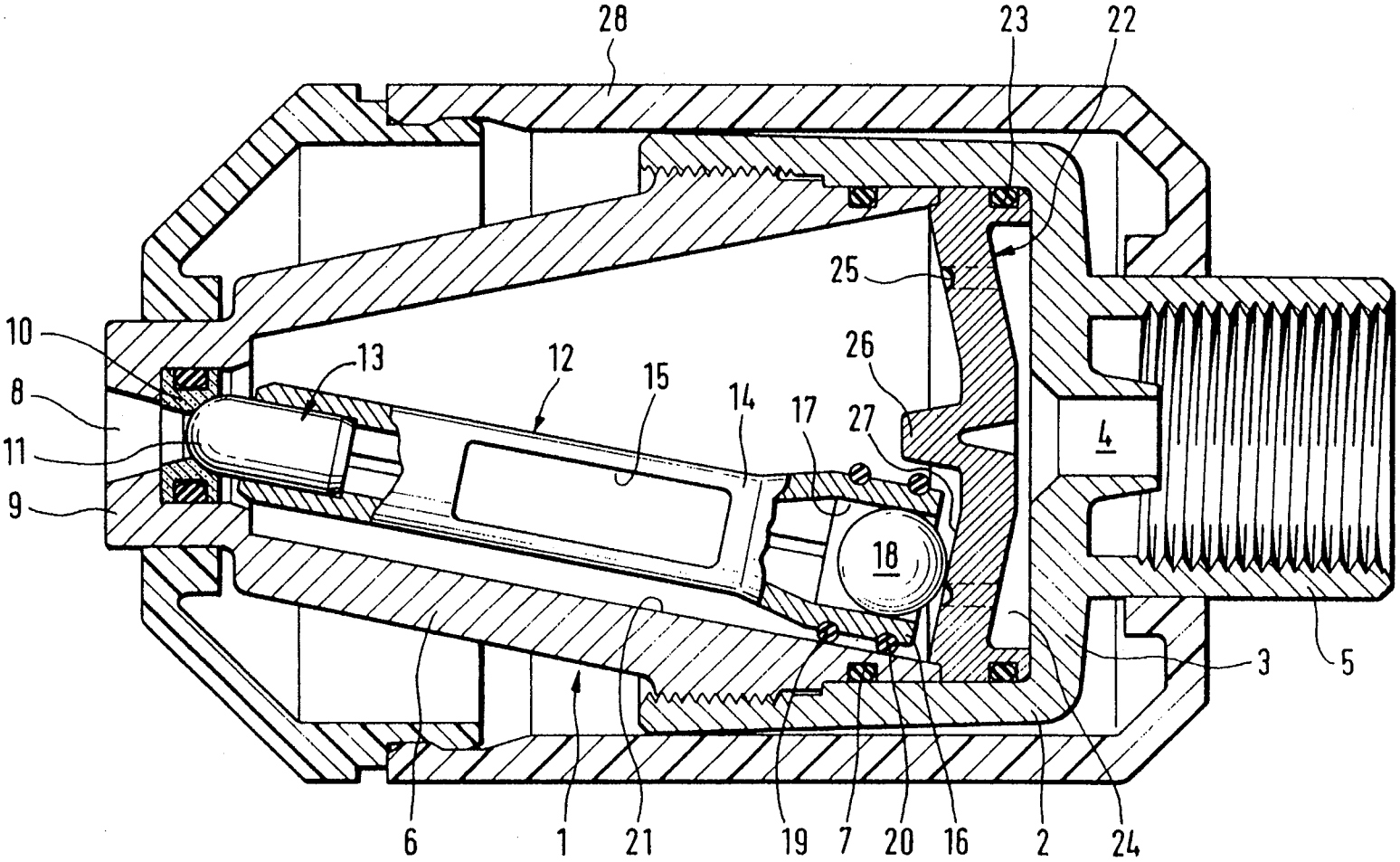
5
3
4
22
24
23
2
16
18
20
25
26
27
7
17
19
14
15
21
28
12
1
6
13
10
8
11
9

ROTOR NOZZLE FOR A HIGH-PRESSURE CLEANING DEVICE

The invention relates to a rotor nozzle for a high-pressure cleaning device comprising a housing provided in a front wall with a pan-shaped bearing for the front, spherical end of a nozzle body having a through-bore, with an inlet for a liquid opening tangentially into the housing, the liquid in the housing being caused to rotate thereby about the longitudinal axis of the housing, so that the nozzle body rotates together with the rotating liquid and thereby abuts with a contact surface at its periphery on the inside wall of the housing, whereby the longitudinal axis of the nozzle body is inclined in relation to the longitudinal axis of the housing.

Such a rotor nozzle is known, for example from the German Patent Specification 4 013 446. A particularly simple construction results in such a rotor nozzle since the nozzle body is mounted only on one side, yet it is freely movable in the housing whereby it rotates, on the one hand, on a cone-shaped casing about the longitudinal axis of the housing while, on the other hand, it rotates about its own longitudinal axis. This rotary motion about its own longitudinal axis can be reduced extensively in that an increased friction is provided in the region of the contact surface. However, this does not succeed in reducing the rotational frequency of the nozzle body in the housing.

It has been ascertained that such a limitation of rotational speed is desired in constructions of this type.

In rotor nozzles of another constructional type (DE-PS 3 532 045) in which a rotor is rotatably mounted in the housing about an axis fixed with respect to the housing, the limitation of rotational speed of the rotor is achieved in that ball-shaped braking members are mounted in the rotor for free displacement in radial direction, abut on the outer casing of the housing and generate a braking force which increases with the rotational speed of the rotor body. Such a construction is usable only when a rotor is rotatably mounted in the housing about an axis fixed with respect to the housing. When using a freely rotating nozzle body which, in addition, rotates about its own longitudinal axis, a radial braking at the cylindrical inside wall of the rotor housing is not readily possible.

The object of the invention in a rotor nozzle of the type described at the outset is to achieve an effective limitation of rotational speed.

This object is accomplished in accordance with the invention, in a rotor nozzle of the type described at the outset, in that a braking member is mounted in the nozzle body at its back end facing away from the front, spherical end for displacement in longitudinal direction of the nozzle body and that a contact surface is arranged adjacent to the back end of the nozzle body at the end face in the housing, the braking member mounted in the nozzle body protruding beyond the end of the nozzle body to abut on this contact surface as soon as the nozzle body rotates in the housing.

Thus, a braking member is mounted in the nozzle body which is displaceable in the direction of the longitudinal axis of the nozzle body. Since this longitudinal axis is slanted with respect to the longitudinal axis of the housing and thus to the rotational axis during the rotational motion of the nozzle body in the housing, a component displacing the braking member in the direction of the longitudinal axis of the nozzle body also results by means of the centrifugal force and this component presses the braking member out of the nozzle body against the contact surface at the end face. This contact results in an effective braking force which limits the rotational frequency of the nozzle body in the housing, whereby this limitation of rotational speed functions independent of which position the nozzle body takes up about its longitudinal axis. Thus, the nozzle body can rotate freely about its longitudinal axis and, nevertheless, the rotational frequency of the nozzle body in the housing is effectively limited. The braking forces increase with increasing rotational frequency.

A further advantage of this construction is also in the fact that the braking member which, for example, can be designed as a steel body, also exerts an increasing radial component on the nozzle body, due to its great weight, with increasing rotational speed and this component presses this nozzle body with increased force against the inside wall of the housing. This, on the other hand, contributes to additionally decreasing the inherent rotation of the nozzle body about the longitudinal axis.

The braking member can, for example, be a ball.

A particularly simple design results when the braking member is mounted for free displacement in a cylindrical blind hole at the back end of the nozzle body.

The contact surface for the braking member can be designed as a ring surface which is arranged vertically to the longitudinal axis of the nozzle body in the contact area of the braking member. With that, the contact surface, as a whole, has a slight conical form due to the inclination of the longitudinal axis of the nozzle body in relation to the longitudinal axis of the housing.

In addition, the contact surface can bear a central projection which protrudes into the interior of the housing beyond the back end of the nozzle body supported in the pan-shaped bearing. Hereby, it is guaranteed that also before operation, the nozzle body does not align itself centrally in the housing but retains an inclination in relation to the longitudinal axis of the housing. When operation is started, the nozzle body is thus immediately pressed effectively against the inside surface of the housing.

The rotational frequency of the nozzle body in the housing is additionally decreased in a preferred embodiment of the invention, in that the nozzle body abuts on the inside wall of the housing via at least two contact surfaces at its periphery offset in relation to each other in the direction of its longitudinal axis. Due to the inclined position of the nozzle body in the housing, rolling paths of different lengths of the contact surfaces on the inside wall of the housing result during the rolling movement of the nozzle body on the inside wall of the housing so that a slippage occurs in this area. This slippage additionally brakes the rotational movement of the nozzle body in the housing and contributes to the limitation of the rotational frequency.

The decrease in the rotational frequency of the nozzle body by means of two contact surfaces offset in relation to each other in the direction of the longitudinal axis of the nozzle body is particularly advantageous in combination with a braking member freely movable in longitudinal direction of the nozzle body, which abuts on a contact surface at the end face and for its part, effects a reduction of the rotational frequency. The measure of the two contact surfaces offset in longitudinal direction can also be used on its own to decrease the rotational frequency, for example, in that two or more contact surfaces are provided in longitudinal direction on a nozzle body which does not have a movable braking member. Thereby, the reduction of the rotational frequency can be improved in such a solution when the end region of the nozzle body, in which the contact surfaces are located, has a greater weight either by means of a massive design of the nozzle body in this area or by means of embedding a weight. This decrease of the rotational frequency by means of at least two contact surfaces without combination with a movable braking member abutting on the end face, is also the subject matter of the invention.

The contact surface can, for example, be formed by O-rings.

In a preferred embodiment, it is provided that the inside wall of the housing extends parallel to the longitudinal axis of the nozzle body abutting on the inside wall and the nozzle length bears contact surfaces of equal external diameters.

It is thereby advantageous for the at least two contact surfaces to be arranged in the area of the back end of the nozzle body and to surround the mounting of the braking member in the nozzle body. Hereby, the braking member presses the contact surfaces with increasing force against the inside wall of the housing during increasing rotational speed due to the radially effective centrifugal forces, so that the braking action is also increased by slippage.

The following description of a preferred embodiment of the invention serves to explain the invention in greater detail in conjunction with the drawing. The drawing shows a longitudinal section through a rotor nozzle with limitation of the rotational frequency of the nozzle body.

The rotor nozzle represented in the drawing comprises a housing 1 with a back half 2 which is of a cup-shaped design and has a central opening 4 in its base 3. A connecting piece 5 is integrally formed at this opening 4 on the underside of the base 3 and with the aid of which the housing 1 can, for example, be screwed onto the end of a jet pipe of a high-pressure cleaner.

A front half 6 is screwed into the back half 2 of the housing 1 and is sealed off in relation to the first half 2 by means of an O-ring seal 7. The second half 6 is designed essentially frustum-shaped and ends at its narrow end in a front wall 9 provided with a central opening 8 in which a pan-shaped bearing 10 is held surrounding the opening 8.

In this bearing 10, the spherical front end 11 of a nozzle body 12 is supported which essentially comprises a nozzle 13 and a hollow cylinder 14 joined thereto. The nozzle 13 is securely inserted into the one end of the hollow cylinder 14, the interior space of the hollow cylinder 14 is in communication with a nozzle bore in the nozzle 13. In the side wall of the hollow cylinder 14, windows 15 are arranged which provide a flow connection between the interior space of the hollow cylinder 14, on the one hand, and the interior space of the housing 1, on the other hand.

At the back end 16 of the nozzle body 12 opposite the nozzle 13, the hollow cylinder 14 has a slightly larger diameter than in the remaining area and forms a receiving bore 17 here for a ball-shaped braking member 18, which is guided for free displacement parallel to the longitudinal axis of the nozzle body 12 in the receiving bore 17.

On the outside, the hollow cylinder 14 bears two O-rings 19 and 20 at an axial distance from each other in the area surrounding the receiving bore 17, both rings abutting on the inside wall 21 of the second half 6 of the housing 1. This inside wall 21 extends parallel to the longitudinal axis of the nozzle body 12 lying against the inside wall so that both O-rings 19 and 20 which are arranged on the cylindrical outside wall of the hollow cylinder 14 are pressed with substantially equal force against the inside wall 21.

An insert 22 extending essentially parallel to the base 3 is pushed into the back half 2 of the housing 1 between its base 3 and the lower edge of the front half 6 and this insert is sealed off with respect to the inside wall of the back half 2 of the housing 1 by means of an O-ring seal 23. The insert 22 together with the base 3 forms a distributor space 24 which, on the one hand, is in communication with the opening 4 in the base 3 and, on the other hand, in communication with bores 25 in the insert 22 entering at an inclination from the distributor space 24 with tangential components into the interior of the housing 1.

On the side facing the interior of the housing, the insert 22 has a projection 26 protruding centrally into the interior of the housing which projects beyond the back end 16 of the nozzle body 12 and thereby prevents the nozzle body from aligning itself centrally in the housing 1.

The projection 26 is surrounded by a ring-shaped contact surface 27 which is aligned essentially vertical to the longitudinal axis of the nozzle body 12 abutting on the inside wall of the housing 1. This contact surface 27 is located at a slight distance from the back end 16 of the nozzle body 12 so that the braking member 18 freely displaceable in the receiving bore 17 can come to rest against the contact surface 27 as long as it is still located in the receiving bore 17.

The housing 1 is surrounded by a two-piece outer housing 28 which can, for example, be made of plastics. It surrounds the housing 1 like a casing, in the area of the connecting piece 5 and in the area of the opening 8 the housing 1 passes through the outer housing 28.

During operation, cleaning liquid under high pressure is fed into the distributor space 24 via the connecting piece 5 and the opening 4 and from there reaches the interior of the housing 1 via the bores 25. Hereby, a liquid filling rotating about the longitudinal axis of the housing is achieved in this inner space. This takes along the nozzle body 12 supported in the bearing 10 with its spherical end 11, the nozzle body thereby being pressed with the O-rings 19 and 20 against the inside wall of the front half 6 of the housing 1.

The liquid reaches the outside from the interior of the housing 1 via the windows 15 and the nozzle 13 in the form of a compact jet of cleaning agent whereby this jet circulates on a cone-shaped casing which penetrates the opening 8.

By means of the rotation of the nozzle body 12 about the longitudinal axis of the housing 1, a force directed radially outwards is exerted on the spherical braking member 18 in the receiving bore 17 and presses the nozzle body 12 with increased force against the inside wall of the front half 6 of the housing 1, on the one hand, while, on the other hand, the component of this force directed parallel to the longitudinal direction of the nozzle body 12 presses the braking member 18 against the contact surface 27. These forces become greater with increasing rotational frequency so that the braking forces generated by the contact of the braking member at the contact surface 27 increase likewise. This leads to a limitation of the rotational frequency of the nozzle body 12 in the housing 1. The increased forces with which the two O-rings 29 and 20 are pressed against the inside wall of the front half 6 of the housing 1 act in the same direction. Since the paths to be covered by each of the two O-rings during a rotation in the housing along the conical inside wall are of different lengths, a slippage occurs between the O-rings 19 and 20, on the one hand, and the inside wall, on the other hand, which also limits the rotational frequency. This effect is increased by the increase of the contact forces by means of which the O-rings 19 and 20 are pressed against the inside wall under the influence of the braking member 18 during increasing rotational speed.

The construction of the rotor body is arranged such that an assembly and disassembly is possible with little effort. For assembly, the insert 22 is firstly placed into the back half 2 of the housing 1, subsequently the front half 6 of the housing 1 is screwed with the back half 2 together with the nozzle body inserted in the bearing 10. The spherical braking member 18 is thereby loosely inserted into the nozzle body 12, besides this, the O-rings 19 and 20 are attached. These parts possibly subject to wear and tear can easily be interchanged in that the two halves 2 and 6 of the housing 1 are unscrewed.

I claim:

1. A rotor nozzle for a high-pressure cleaning device comprising:

a housing having a front wall provided with a pan-shaped bearing for a front, spherical end of a nozzle body having a through-bore;

an inlet for a liquid opening tangentially into the housing such that liquid introduced into the housing thereby will rotate about a longitudinal axis of the housing and cause the nozzle body to rotate and a peripheral contact surface of the nozzle body to abut against an inside wall of the housing, with the longitudinal axis of the nozzle body being inclined in relation to the longitudinal axis of the housing;

a braking member mounted in a back end of the nozzle body facing away from the front, spherical end for displacement in the longitudinal direction of the nozzle body;

an end face contact surface arranged adjacent to the back end of the nozzle body at an end face of the housing;

wherein the braking member protrudes beyond said back end to abut on said end face contact surface as soon as the nozzle body rotates in the housing.

2. A rotor nozzle according to claim 1, wherein said braking member is a ball.

3. A rotor nozzle in accordance with claim 2, wherein the nozzle body abuts on the inside wall of the housing via at least two peripheral contact surfaces offset in relation to each other in the direction of the longitudinal axis of said nozzle body, said peripheral contact surfaces having rolling paths on the inside wall of the housing that are of different lengths.

4. A rotor nozzle according to claim 1, wherein the braking member is mounted for free displacement in a cylindrical receiving bore at the back end of the nozzle body.

5. A rotor nozzle in accordance with claim 4, wherein the nozzle body abuts on the inside wall of the housing via at least two peripheral contact surfaces offset in relation to each other in the direction of the longitudinal axis of said nozzle body, said peripheral contact surfaces having rolling paths on the inside wall of the housing that are of different lengths.

6. A rotor nozzle according to claim 1, wherein the end face contact surface is designed as a ring surface arranged substantially perpendicular to the longitudinal axis of the nozzle body in the area of contact of the braking member.

7. A rotor nozzle according to claim 6, wherein the end face contact surface bears a central projection protruding into the inside of the housing beyond the back end of the nozzle body.

8. A rotor nozzle in accordance with claim 1, wherein the nozzle body abuts on the inside wall of the housing via at least two peripheral contact surfaces offset in relation to each other in the direction of the longitudinal axis of said nozzle body, said peripheral contact surfaces having rolling paths on the inside wall of the housing that are of different lengths.

9. A rotor nozzle according to claim 8, wherein each of said peripheral contact surfaces is formed by an O-ring.

10. A rotor nozzle according to claim 9, wherein the inside wall of the housing extends parallel to the longitudinal axis of the nozzle body, and the peripheral contact surfaces are of equal external diameter.

11. A rotor nozzle according to claim 10, wherein the at least two peripheral contact surfaces are arranged in the area of the back end of the nozzle body and surround the mounting of the braking member in the nozzle body.

12. A rotor nozzle according to claim 9, wherein the at least two peripheral contact surfaces are arranged in the area of the back end of the nozzle body and surround the mounting of the braking member in the nozzle body.

13. A rotor nozzle according to claim 8, wherein the inside wall of the housing extends parallel to the longitudinal axis of the nozzle body, and the peripheral contact surfaces are of equal external diameter.

14. A rotor nozzle according to claim 13, wherein the at least two peripheral contact surfaces are arranged in the area of the back end of the nozzle body and surround the mounting of the braking member in the nozzle body.

15. A rotor nozzle according to claim 8, wherein the at least two peripheral contact surfaces are arranged in the area of the back end of the nozzle body and surround the mounting of the braking member in the nozzle body.

16. A rotor nozzle for a high-pressure cleaning device comprising:

a housing having a front wall provided with a pan-shaped bearing for a front, spherical end of a nozzle body having a through-bore;

an inlet for a liquid opening tangentially into the housing such that liquid introduced into the housing thereby will rotate about a longitudinal axis of the housing and cause the nozzle body to rotate and at least two contact surfaces about its periphery to abut against a single inside wall surface of the housing, with the longitudinal axis of the nozzle body being inclined in relation to the longitudinal axis of the housing;

said at least two contact surfaces being offset in relation to each other in the direction of the longitudinal axis of said nozzle body, said contact surfaces having rolling paths on the inside wall surface of the housing that are of differing lengths.

17. A rotor nozzle according to claim 16, wherein each of said contact surfaces is formed by an O-ring.

18. A rotor nozzle according to claim 17, wherein the inside wall surface of the housing extends parallel to the longitudinal axis of the nozzle body, and the contact surfaces are of equal external diameter.

19. A rotor nozzle according to claim 17, further comprising a braking member mounted in a back end of the nozzle body, wherein the at least two contact surfaces are arranged in the area of the back end of the nozzle body and surround the mounting of the braking member in the nozzle body.

20. A rotor nozzle according to claim 16, wherein the inside wall surface of the housing extends parallel to the longitudinal axis of the nozzle body, and the contact surfaces are of equal external diameter.

21. A rotor nozzle according to claim 20, further comprising a braking member mounted in a back end of the nozzle body, wherein the at least two contact surfaces are arranged in the area of the back end of the nozzle body and surround the mounting of the braking member in the nozzle body.

22. A rotor nozzle according to claim 16, further comprising a braking member mounted in a back end of the nozzle body, wherein the at least two contact surfaces are arranged in the area of the back end of the nozzle body and surround the mounting of the braking member in the nozzle body.

* * * * *